US011389363B2

(12) United States Patent
Bouchet

(10) Patent No.: US 11,389,363 B2
(45) Date of Patent: Jul. 19, 2022

(54) VIBRATING MASSAGE TABLE

(71) Applicant: Bodyfeed, Charleville-Mezies (FR)

(72) Inventor: Antoine Bouchet, Charleville-Mezies (FR)

(73) Assignee: Bodyfeed, Charleville-Mezies (FR)

( * ) Notice: Subject to any disclaimer, the term of this patent is extended or adjusted under 35 U.S.C. 154(b) by 0 days.

(21) Appl. No.: 17/272,595

(22) PCT Filed: Sep. 3, 2019

(86) PCT No.: PCT/EP2019/073451

§ 371 (c)(1),
(2) Date: Mar. 1, 2021

(87) PCT Pub. No.: WO2020/048971

PCT Pub. Date: Mar. 12, 2020

(65) Prior Publication Data

US 2021/0282999 A1 Sep. 16, 2021

(30) Foreign Application Priority Data

Sep. 3, 2018 (FR) ..... 1857904
Mar. 29, 2019 (EP) ..... 19166233

(51) Int. Cl.
*A61H 1/00* (2006.01)
*A61H 23/00* (2006.01)

(52) U.S. Cl.
CPC ..... *A61H 1/005* (2013.01); *A61H 1/003* (2013.01); *A61H 23/006* (2013.01); *A61H 2201/1604* (2013.01); *A61H 2203/0443* (2013.01)

(58) Field of Classification Search
CPC ..... A61H 1/00; A61H 1/001; A61H 1/003; A61H 1/005; A61H 1/006; A61H 1/008;
(Continued)

(56) References Cited

U.S. PATENT DOCUMENTS 2,893,380 A 7/1959 Patrick et al.
3,060,925 A 10/1962 Honsaker et al.
(Continued)

FOREIGN PATENT DOCUMENTS

CN 107854271 A 3/2018
DE 9313660 U1 1/1994
(Continued)

OTHER PUBLICATIONS

Aug. 7, 2020 Preliminary Report Chapter 2 PCT/EP2019/073451.

*Primary Examiner* — Bradley H Philips
*Assistant Examiner* — Savannah L Gabriel
(74) *Attorney, Agent, or Firm* — Veritay Group IP, PLLC; Susan B. Fentres; Liam O'Donnell

(57) ABSTRACT

The invention relates to a vibrating massage table (1) including a support leg (3) on which rests a table top (2) tilting about a joint (4) with a central axis (40) and permitting an inclination of a patient, said table top being subdivided longitudinally into several butt-joined transverse cushions (5, 6, 7, 8, 9, 10) each adapted to a part of the body, one of the cushions (10), adapted to the ankles and the feet of the patient, being subdivided into two portions activated to vibrate alternately by at least one motor means.

Said table includes means for modifying the height and/or means for modifying the inclination of at least one of the cushions by lifting one or the other of the transverse edges of said cushion.

The platform is subdivided into two frames (21, 22) articulated to each other at the level of a joint (41), for an inclination between said frames.

9 Claims, 9 Drawing Sheets

(58) Field of Classification Search
CPC ..... A61H 1/02; A61H 1/0218; A61H 1/0222; A61H 1/0229; A61H 1/0237; A61H 1/0255; A61H 1/0259; A61H 1/0274; A61H 1/0292; A61H 2201/1604; A61H 2201/1607; A61H 2201/1609; A61H 2201/1611; A61H 2201/1614; A61H 2201/1616; A61H 2201/1619; A61H 2201/1621; A61H 2201/1623; A61H 2201/1626; A61H 2201/1628; A61H 2201/163; A61H 2201/1676; A61H 2201/0142; A61H 2201/0146; A61H 23/00; A61H 23/004; A61H 23/006; A61H 23/02; A61H 23/0254; A61H 23/04; A61H 2203/0443; A61H 2203/045; A61H 2203/0456; A61H 2203/0462; A61H 2203/0468; A61G 13/009; A61G 13/08; A61G 7/005; A61G 7/015; A47C 21/006; A47C 7/72; A47C 7/144
USPC ..... 297/217.3, 284.3
See application file for complete search history.

(56) References Cited

U.S. PATENT DOCUMENTS

| | | | | |
|---|---|---|---|---|
| 3,062,205 | A | 11/1962 | Loiacano | |
| 4,207,879 | A | 6/1980 | Safadago et al. | |
| 4,608,969 | A | 9/1986 | Hamlin | |
| 5,437,607 | A | 8/1995 | Taylor | |
| 6,178,577 | B1 | 1/2001 | Chien-Chuan | |
| 7,127,757 | B2 * | 10/2006 | Roberto | A61H 1/0222 5/613 |
| 9,226,863 | B1 * | 1/2016 | El-Messeiry | A61G 7/057 |
| D846,126 | S | 4/2019 | Bouchet | |
| 2006/0123456 | A1 * | 6/2006 | Dei | H04N 7/162 725/146 |
| 2009/0094745 | A1 * | 4/2009 | Benzo | A61G 7/053 5/608 |
| 2010/0222724 | A1 * | 9/2010 | Huang | A61G 7/0573 601/115 |
| 2010/0313897 | A1 | 12/2010 | Schaeffer | |
| 2011/0132377 | A1 * | 6/2011 | Phillips | A61H 9/0078 128/845 |
| 2012/0198627 | A1 * | 8/2012 | Turner | A61G 7/015 5/610 |
| 2012/0209156 | A1 * | 8/2012 | Leismer | A61H 23/0263 601/49 |
| 2013/0025066 | A1 * | 1/2013 | Shih | A47C 21/006 5/694 |
| 2013/0184615 | A1 | 7/2013 | Johnson | |
| 2014/0018712 | A1 * | 1/2014 | Bouchet | A61H 23/02 601/56 |
| 2014/0082835 | A1 * | 3/2014 | Husslage | A61G 13/009 5/2.1 |
| 2017/0135890 | A1 * | 5/2017 | DuBois | A61G 13/08 |
| 2020/0029706 | A1 * | 1/2020 | Yao | A47C 31/123 |

FOREIGN PATENT DOCUMENTS

| | | | |
|---|---|---|---|
| DE | 10353714 | A1 | 6/2004 |
| FR | 2992853 | B1 | 7/2015 |
| WO | 2006079327 | A1 | 8/2006 |
| WO | 2009055432 | A3 | 6/2009 |

* cited by examiner

[Fig. 1]
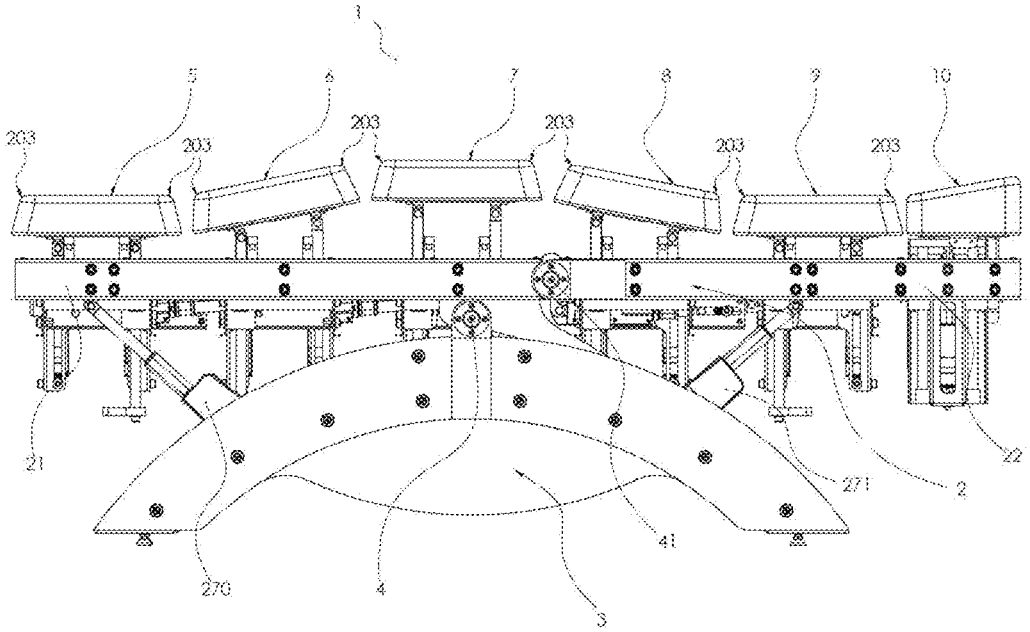
[Fig. 2]
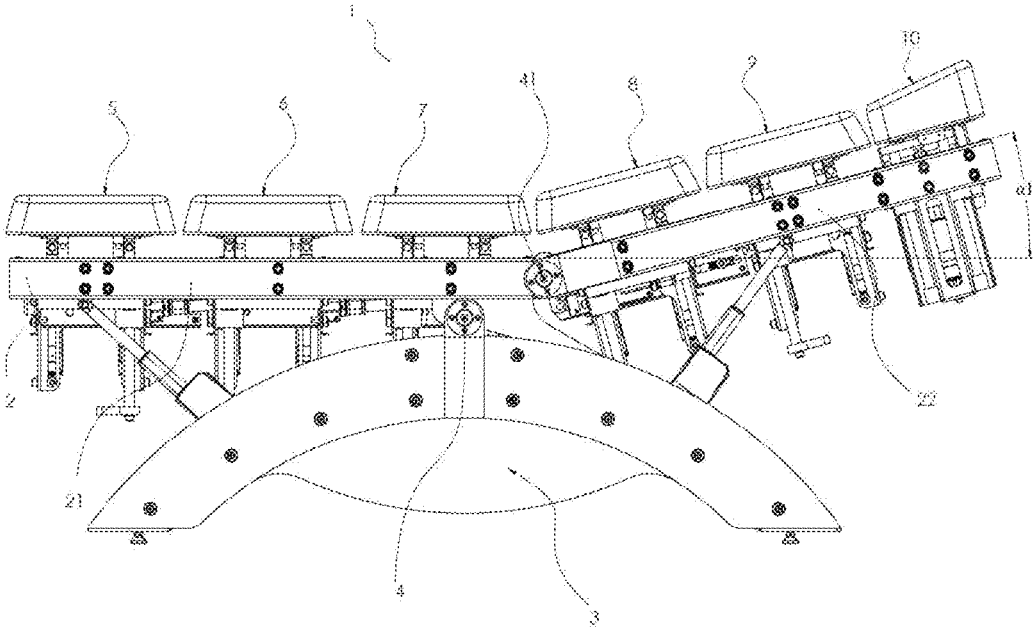

[Fig. 3]
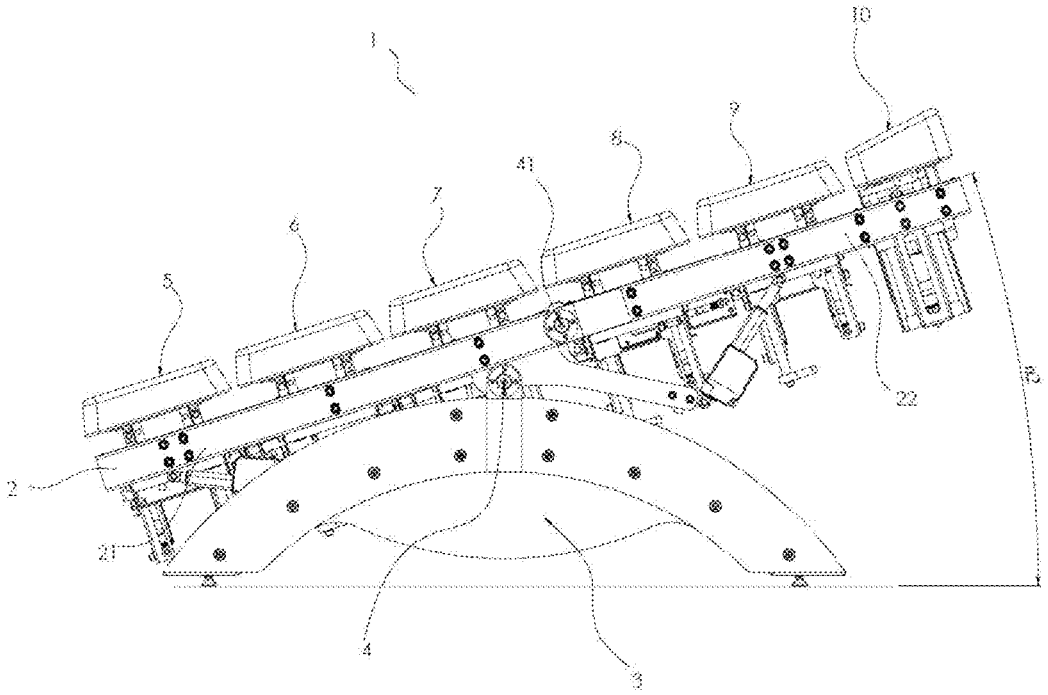
[Fig. 4]
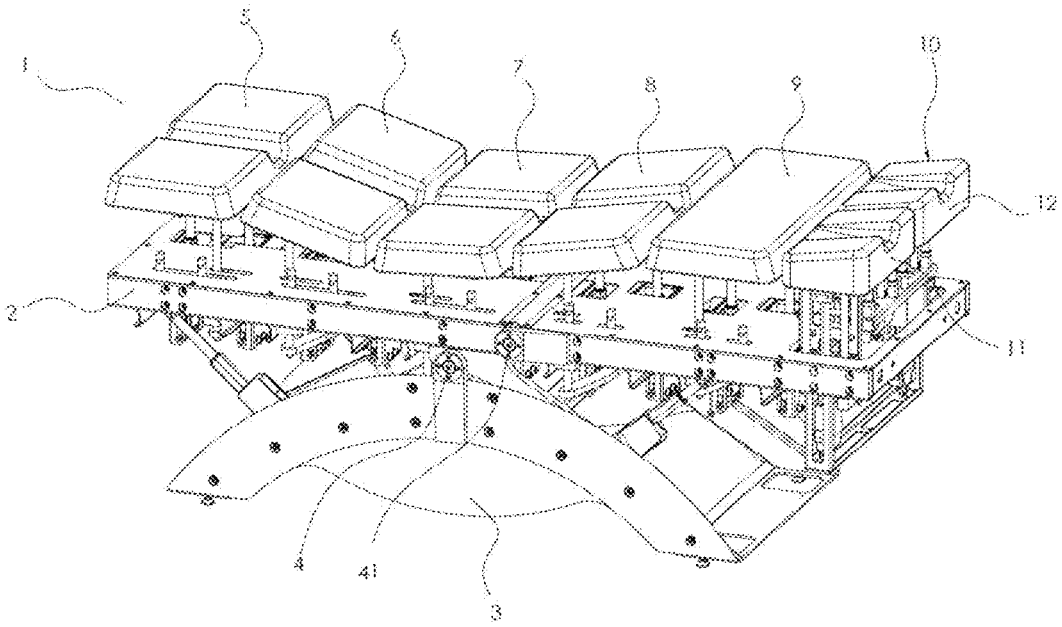

[Fig. 5]
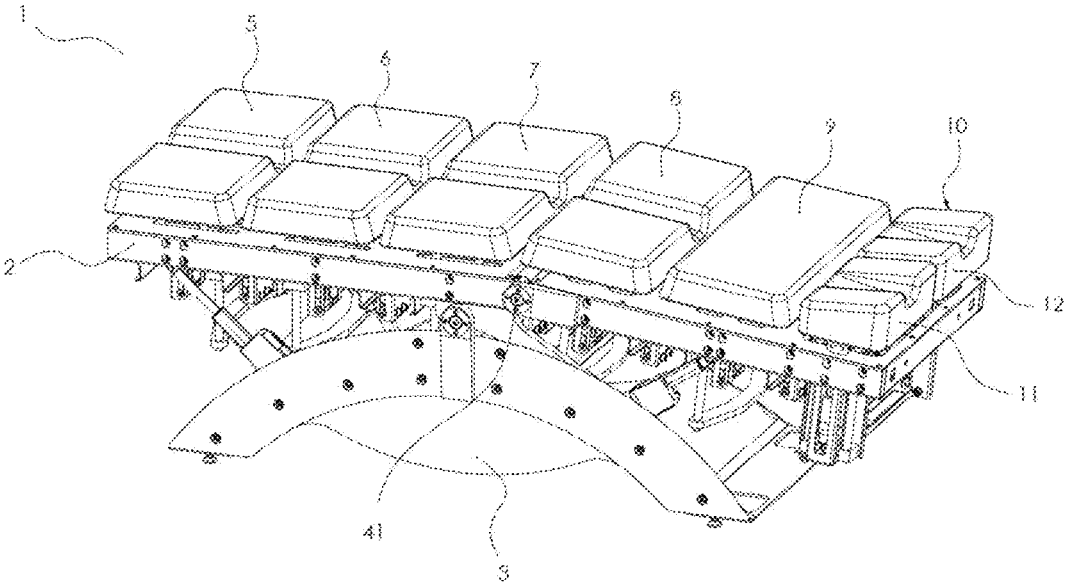
[Fig. 6a]
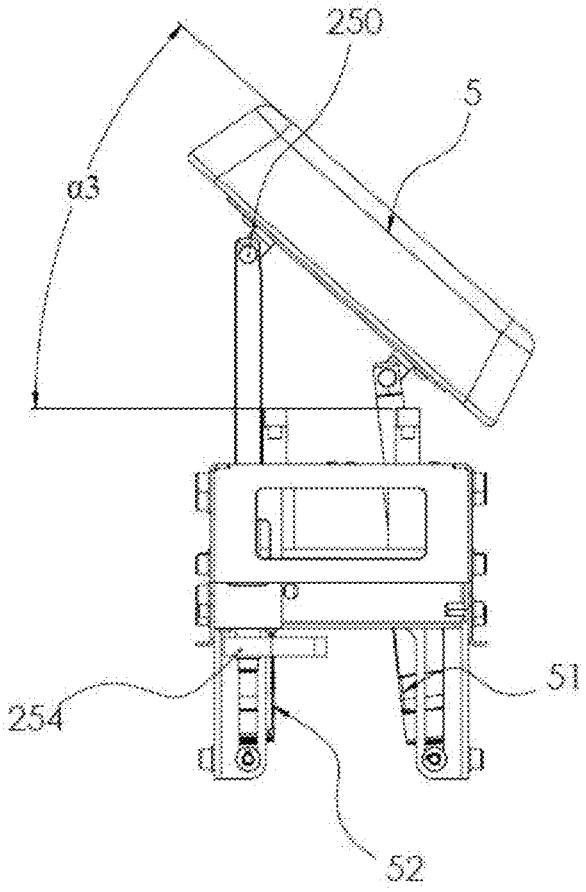

[Fig. 6b]
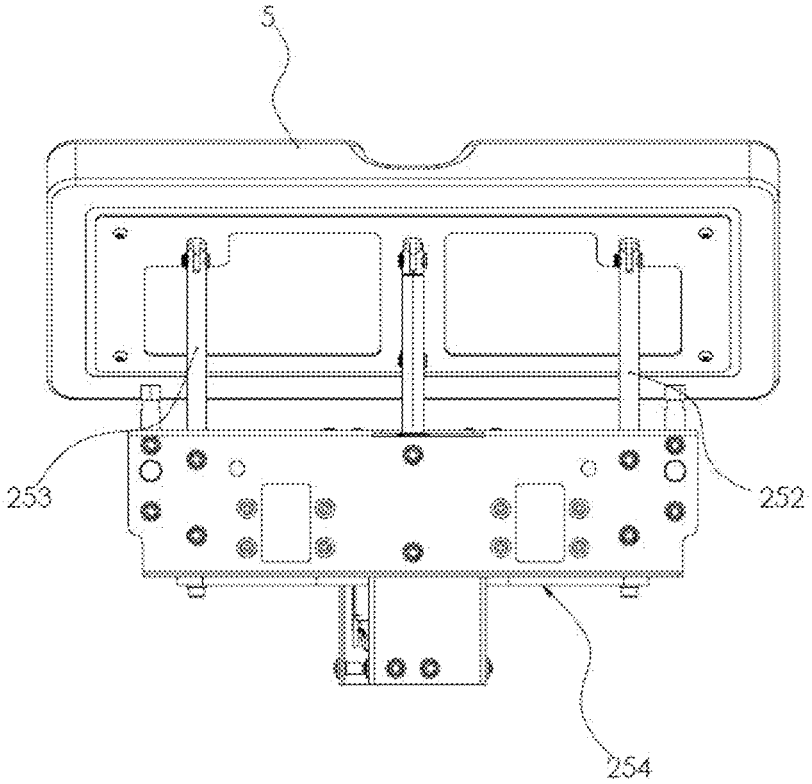
[Fig. 6c]
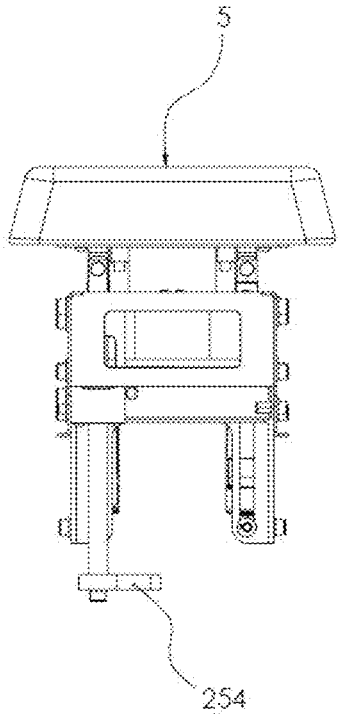

[Fig. 6d]
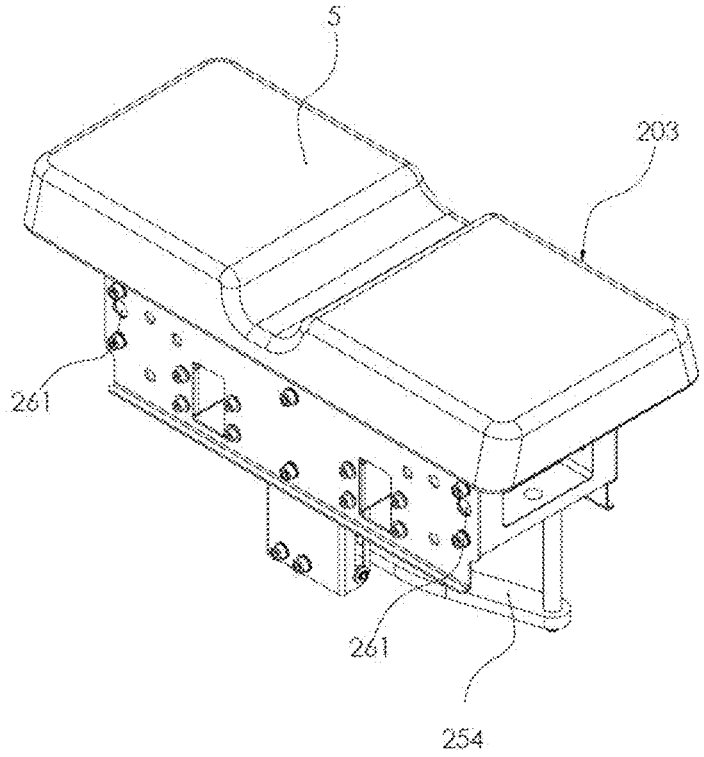
[Fig. 7a]
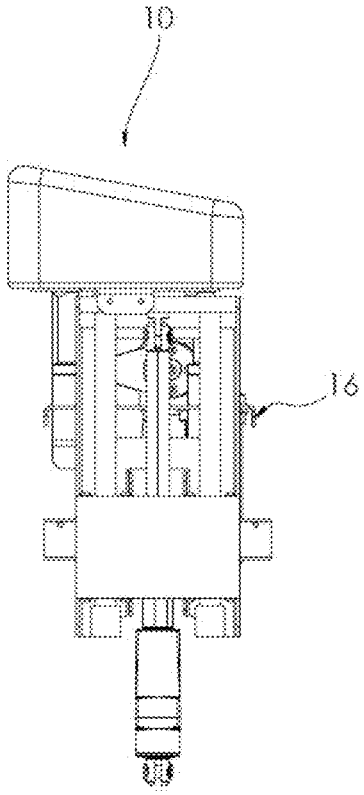

[Fig. 7b]
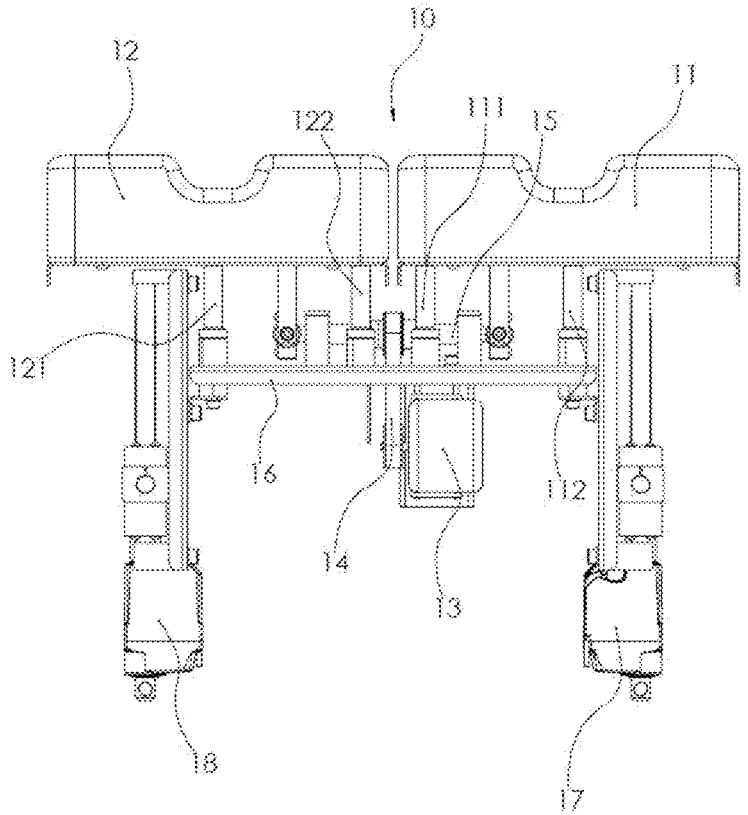
[Fig. 7c]
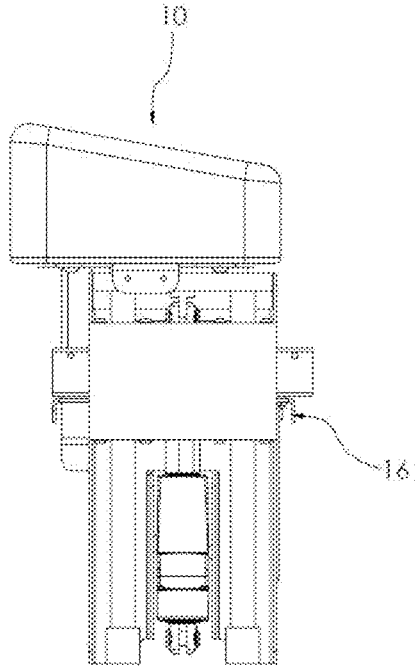

[Fig. 7d]
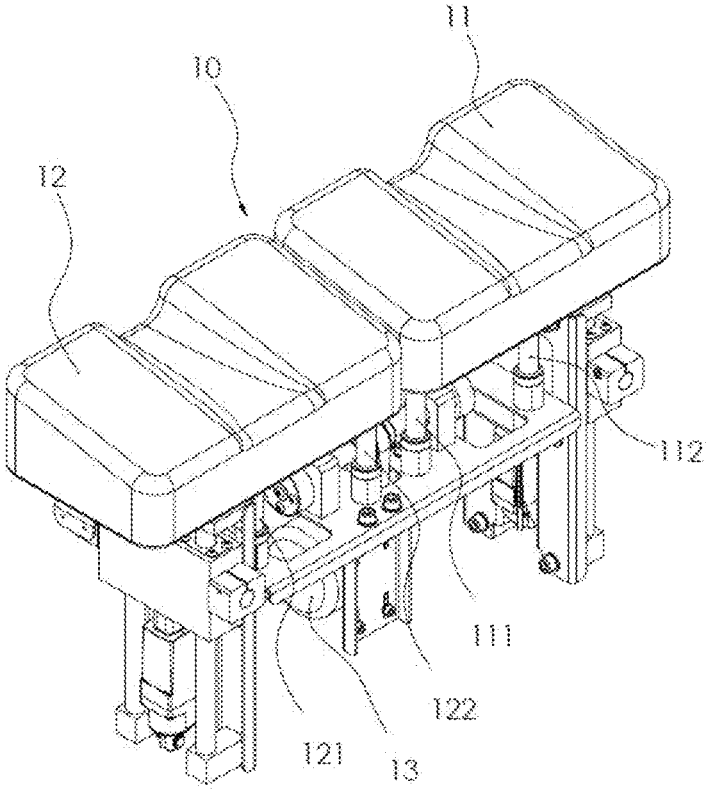
[Fig. 8]
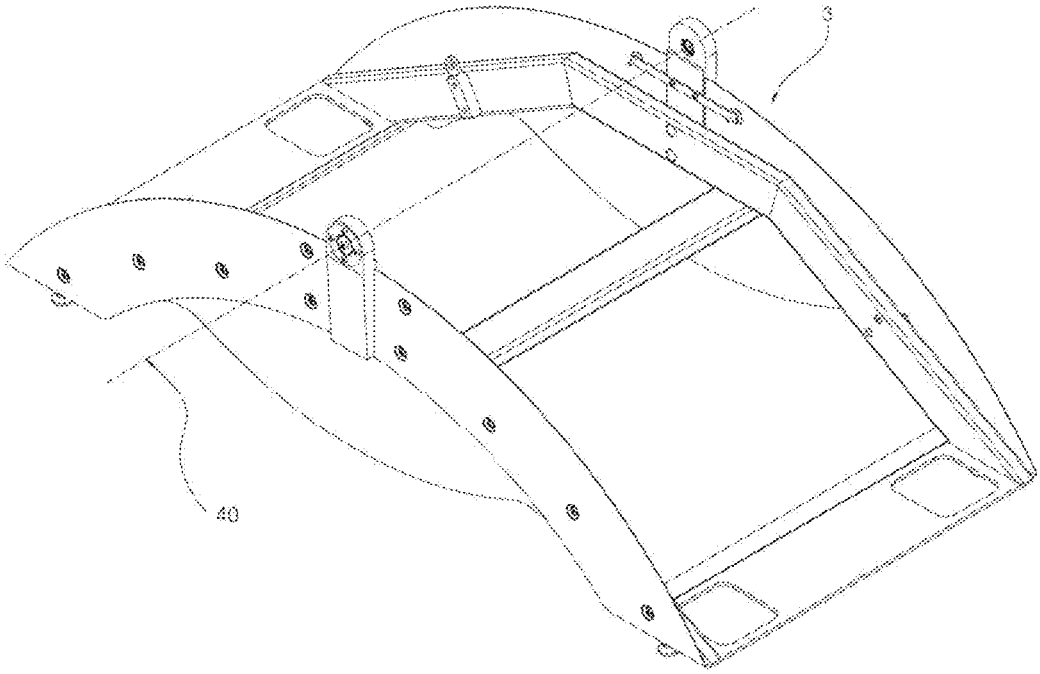

[Fig. 9]
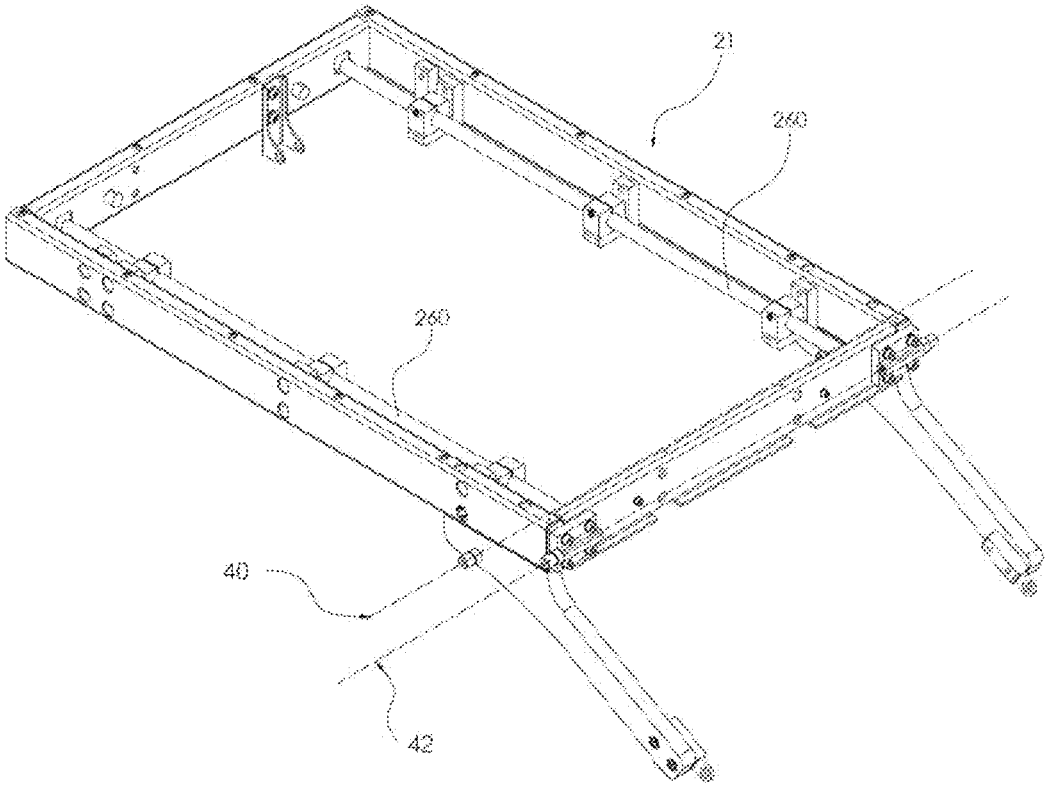
[Fig. 10]
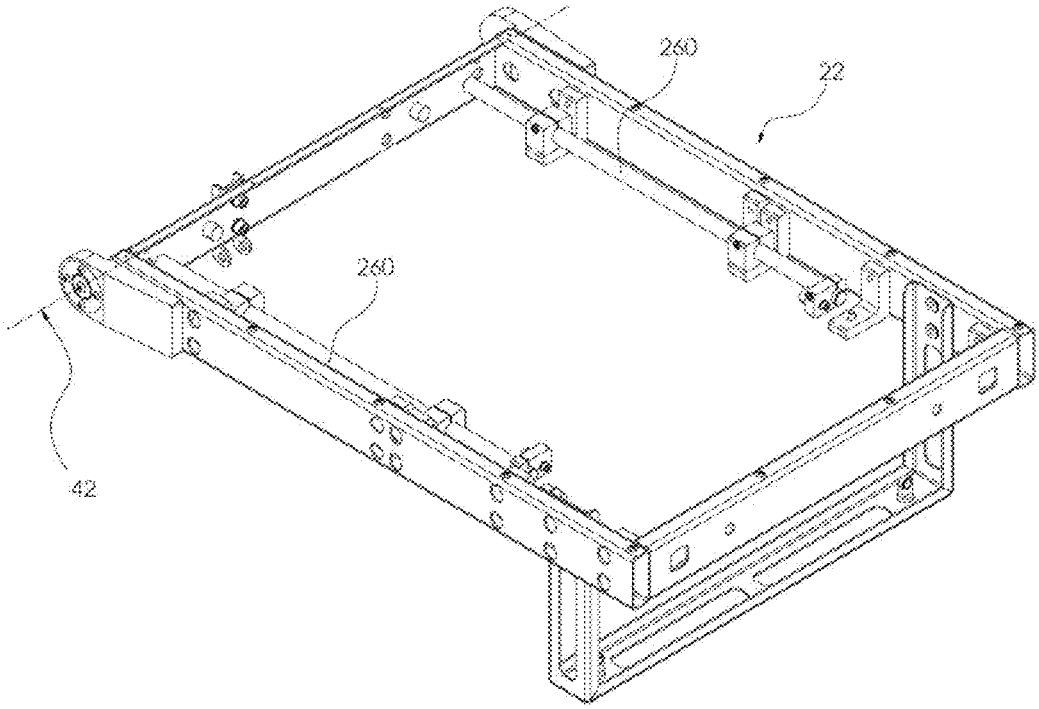

[Fig. 11]
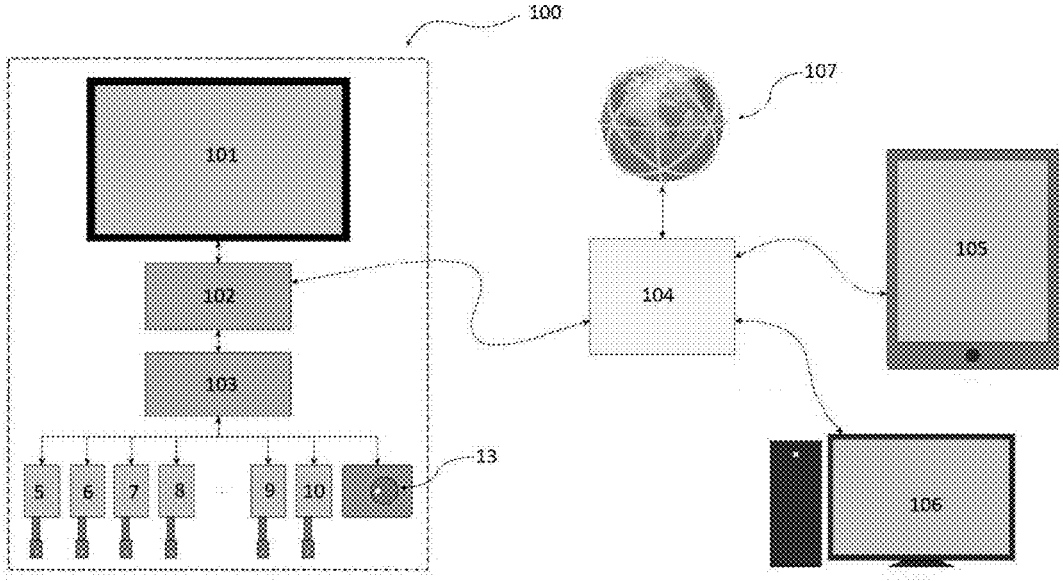
[Fig. 12]
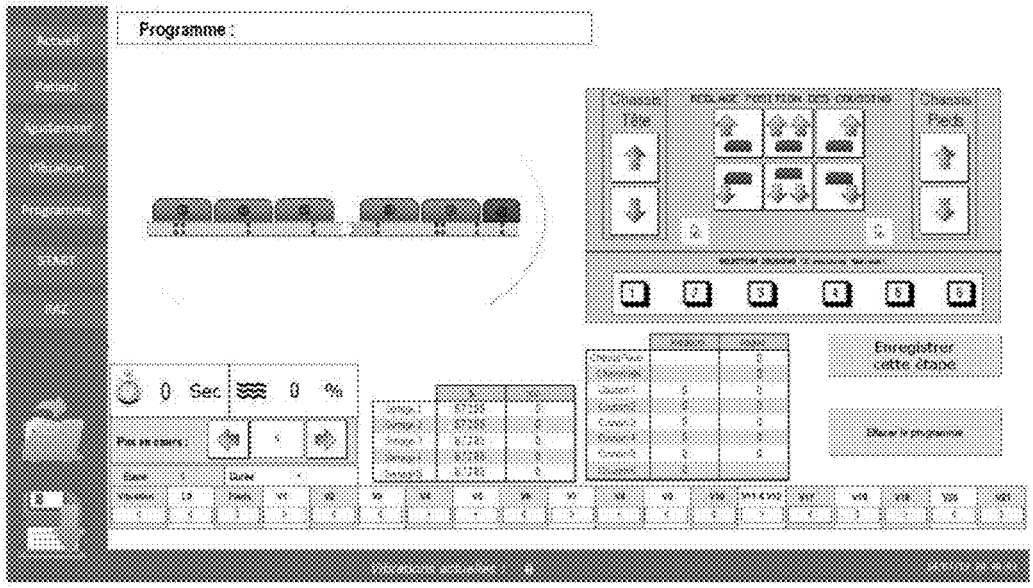

VIBRATING MASSAGE TABLE

CROSS REFERENCE TO RELATED APPLICATIONS

This application is a national stage filing of PCT application EP2019/073451 filed Sep. 3, 2019 which claims the benefit of EP19166233.7 of Mar. 29, 2019 and French patent application no 1857904 filed Sep. 3, 2018 (hereby specifically incorporated herein by reference in their entirety).

BACKGROUND OF THE INVENTION

(1) Field of the Invention

The present invention is related to the field of the devices intended for use for therapeutic or relaxation purposes.

The present invention will find its application mainly in the field of the massage tables.

However, such an application should not be considered as being restrictive; indeed, the present invention can also be applied in the field of tables intended more particularly for relaxation and/or decompression of the intervertebral joints of a patient, for example after a muscular effort.

The invention relates more particularly to a massage table, which can advantageously produce vibrations propagating to the entire body of the person placed on said table.

(2) Description of the Prior Art

Already known in the state of the art, in particular from French patent FR2992853, is such a vibrating massage table, the latter including at least one support leg on which a table top tiltable about a central axis rests for inclining a patient taking place on said table so that the feet of the patient are placed at a level higher than that of his head.

The table top includes at least one motor means propagating vibrations and at least one means for retaining the patient.

The table top of the massage table is subdivided longitudinally into several transverse cushions each adapted to a part of the body, one of the cushions being adapted to the ankles and the feet of the patient, said cushion being activated to vibrate by at least one motor means, said vibrations being propagated from the ankles and the feet to the entire body of the patient.

Generally, the massage tables used by physiotherapists and masseurs include a table top permitting a person to be placed in a lying position, and a plurality of legs supporting said table top and resting on the floor, and can diffuse vibrations to the patient, who needs to be handled.

Advantageously, such a massage table includes means permitting the user to easily fold it up, namely when the latter has to move to the home of the persons, who are to be massaged.

To this end, from patent document FR 970160 is known a vibrating table the table top of which is divided into different elements likely to vibrate independently from each other, in order to promote a post-trauma rehabilitation or to treat different ailments, such as obesity and nervous disorders.

From patent document FR 1108031 is also known a table combining vibrations and mechanical tractions for treating a patient. More particularly, the table described in this document can oscillate in a vertical plane about an axis and has a central axis supporting vibrating table tops, for which it is possible to modify the torsional orientation and, for some table tops, the position in translation relative to the central axis of the table.

From patent document FR 1585871 is also known a specific device for mechanical treatment of the spine and bone connections, i.e. namely of the pelvic ring, the shoulder girdle and the occipital region. More particularly, the table described in this document is tiltable about an axis and it is provided with a single vibrating table top supporting the torso of the patient, so that the vibrations are oriented upwards, irrespective of the inclination of said vibrating table top. The vibrations can be regulated in number and in amplitude.

Patent document RU 2270649 relates, in turn, to a stationary assembly for decompressing by vibration, the aim of which is to permit a decompression of the spine under the effect of vibrations. The vibration mechanism of this device is located under the surface of the table, which is tiltable. The table according to this document is also provided with a device for maintaining, on the one hand, the feet of the patient and, on the other hand, the head of the patient, for example by means of a chinstrap. The inclination of the table causes the spine of the patient to extend, under the weight of his body, and the vibrations are applied to a part located at the front portion of the table, which corresponds to the level where the neck of the patient is located.

Thus, in this document, only one table top, the one located at the front portion of the table, is movable and transmits vibrations to the body of the patient, which does not permit an optimal treatment of the entire body. In addition, maintaining a patient by his head may prove to be difficult for the latter.

In addition, the massage tables provided in the state of the art do not permit the angular position of some parts of the body to be changed independently from other parts of the body, which may prove to be particularly interesting for improving the effectiveness of the treatment, which is provided to the patient.

SUMMARY OF THE INVENTION

The invention provides the possibility of coping, at least partially, with the various drawbacks of the state of the art by providing a table intended to relax or to treat the entire body of a patient, and by permitting an effective treatment of the entire body of the patient, who is located on said table.

In a particularly interesting manner, many elements the massage table of the invention is comprised of are modular and adaptable, in particular angularly and in height, in order to be able to provide an optimized treatment depending on each patient and the pathology for which he has to be treated.

To this end, the present invention relates to a vibrating massage table including at least one support leg on which rests a table top, whether or not capable of tilting about a joint with a central axis, permitting an accurate inclination of a patient, irrespective of whether he lies on his back or his stomach on said table, his ankles thus being placed at a level higher than that of his head.

The table top of the table is subdivided longitudinally into several transverse cushions each adapted to a part of the body, considering the average size of a person in his/her adult years, at least one of the cushions being adapted to the ankles and feet of the patient, said cushion being activated to vibrate by at least one motor means, said vibrations being propagated from the ankles and the feet to the entire body of the patient.

Advantageously, the table top includes:

a first cushion, at one of the ends of the table top, adapted to receive the head of the patient and preferably including a cervical support;

a second cushion adapted to the thorax of the patient;

a third cushion adapted to the lumbar region of the patient;

a fourth cushion adapted to the pelvis and the thighs of the patient;

a fifth cushion adapted to the calves of the patient;

said at least sixth cushion, at the other end of the table top, being adapted to the ankles and the feet of the patient, and activated to vibrate, said cushions being butt-joined, in the direction of the length of the table, by their respective transverse edges.

The table of the invention has the peculiarity of including means for modifying the height of at least one of the cushions and/or means for modifying the inclination of at least one of the cushions, such modification of the inclination being effected by lifting one or the other of the transverse edges of said cushion.

In an exemplary embodiment of the massage table of the invention, said first cushion, adapted to receive the head of the patient and preferably including a cervical support, said second cushion, adapted to the thorax of the patient, said third cushion, adapted to the lumbar region of the patient, said fourth cushion adapted to the pelvis and the thighs of the patient and said fifth cushion, adapted to the calves of the patient, are provided with such means for modifying the height and such means for modifying the inclination by lifting one or the other of the transverse edges of said cushions, while said at least one sixth cushion is provided only with such means for modifying the height.

Thus, it is possible to adjust the height and the inclination, relative to the general plane of the table top, of each or almost each of said cushions, which it is comprised of, each cushion being adapted to receive a part of the body of the patient, and thus to form an undulation along the entire length of the table top of the vibrating massage table of the invention.

Advantageously, the table top of the table is subdivided into two frames, a first frame and a second frame, articulated to each other at the level of a joint so as to permit a variation of the articulating angle $\alpha 1$, which said first frame of the table top forms with said second frame.

Such an articulating angle $\alpha 1$ between said first frame and said second frame of the table top preferably varies between +15° and −8°.

More specifically, the first frame of the table top can include said first cushion, said second cushion and said third cushion, while said second frame can include said fourth cushion, said fifth cushion and said at least one sixth cushion.

Thus, the length of the first frame, which includes said first cushion, said second cushion and said third cushion, is larger than the length of the second frame, which includes, in turn, said fourth cushion, said fifth cushion and said at least one sixth cushion.

According to a particularly preferred embodiment, the cushion, adapted to the ankles and the feet of the patient, is subdivided into two juxtaposed portions, said portions being activated, preferably alternately, to vibrate by at least one motor means, through a transmission belt and a shaft in contact, through its two ends, with each of said two juxtaposed portions.

More preferably, each of the two juxtaposed portions of the cushion adapted to the ankles and the feet of the patient includes at least one means for retaining the ankles and/or the feet of the patient.

According to another peculiarity of the invention, at least one of the transverse cushions is slidably movable relative to the other cushions.

Preferably, the first, second, third, fourth and fifth cushions, provided with linear bearings, are movable relative to the other ones by sliding, over a limited stroke, on two parallel rails located on each side of the table top.

Interestingly, the table top also includes means for managing the sliding capable of limiting the sliding of these mobile cushions.

These means for managing the sliding preferably consist of jacks, for example equipped with springs, which each of said cushions is provided with.

Said springs provided with a jack permit to control the release or the fastening of the cushions with respect to each other. This stroke will advantageously be adapted according to whether a segmentation of the cushions relative to each other is needed or not. This segmentation will be determined according to the size and weight of each patient.

Advantageously, means for tilting about a joint with a central axis permit an inclination of the table top by an angle $\alpha 2$ smaller than or equal to 18° with respect to the horizontal, so that the feet of a patient taking place on said table top are placed at a level higher than that of his head.

As regards now said means for modifying the height of at least one of the cushions, they are capable of varying the height of at least one of the cushions up to a maximum elevation of 150 mm with respect to the basic position of said cushion.

As regards the inclination of at least one of the cushions, this can advantageously vary by an angle $\alpha 3$ between +45° and −45°, the modification of the inclination being effected by lifting one or the other of the transverse edges of said cushion.

The possibility of inclination between +45 and −45° of one of the cushions is obtained in cooperation or not with the lifting of said cushion, and in cooperation or not with the lifting of the neighboring cushions.

Advantageously, said table is provided with a management module at least for the height and/or the inclination of the cushions and, should the case arise, for the articulating angle of the two frames of the table top and the angle of inclination of the table top.

The present invention includes many advantages. On the one hand, the table can be used for both preventive purposes and for curative purposes. Indeed, the table can e.g. be used after a physical effort, thus providing the patient being treated with a relaxing effect, namely at the level of the neuro-musculoskeletal complex. The latter groups the nervous system, the skeleton, the muscles and the tissues permitting the maintaining and the connection between the elements of the human body, such as the cartilage, the tendons and the ligaments.

In addition, the vibration system, preferably placed at the level of the cushions supporting the ankles and the feet, permits a transmission of short and quick vibrations, which then propagate to the rest of the body starting from the lower portion of the body, permitting an overall sensation of relaxation and softness.

In addition, the presence of the means for modifying the height of at least some cushions as well as the means for modifying the inclination by lifting one or the other of the transverse edges, results in an optimal modularity of each portion of the table for a perfect adaptability of the latter to the patient and to the treatment to be applied to the latter. It is in fact possible to consider forming an undulation through the movement of the cushions, which can be adapted according to the adequate treatment decided by the therapist.

Finally, the possibility of combining an articulation between two frames forming the table top of the vibrating massage table with the inclination about the central axis of tilting of said table top provides said table with a particularly important modularity. Thus, it is possible to consider that the entire table top tilts about the preferably central axis for a determined inclination of the table top, then that one of the two frames of the table top is still inclined, with respect to the other frame, through the joint of the table top, also at a determined angle.

Further features and advantages of the invention will become evident from the following detailed description of non-restrictive embodiments of the invention, with reference to the attached figures.

BRIEF DESCRIPTION OF THE DRAWINGS

FIG. 1 schematically shows a particular embodiment of a massage table according to the invention, in a side view, at the level of which two cushions, in this case the cushion adapted to the thorax and the one adapted to the pelvis and the thighs of a patient, are tilted by lifting one of their transverse edges, while the other cushions remain horizontal, in a plane parallel to the general plane of the table top of the table, the cushion adapted to the lumbar region of the patient being raised by lifting its two transverse edges to the same level;

FIG. 2 schematically shows an embodiment of a massage table according to the invention, in a side view, the table top being subdivided into two frames articulated to each other at the level of a joint, one of the frames, intended to accommodate the lower limbs of a patient lying on his back, being raised with respect to the second frame kept substantially horizontal, the configuration of the table permitting the patient to be positioned on his back;

FIG. 3 is another representation of the massage table shown in FIG. 2, the table top of said table being inclined at an angle $\alpha 2$ of about 18° relative to the horizontal through the central joint, so that the feet of the patient are placed at a level higher than his head;

FIG. 4 schematically shows a perspective view of an embodiment of a massage table according to the invention, on the table top of which the cushion adapted to the thorax, the cushion adapted to the lumbar region, the cushion adapted to the pelvis and the thighs of the patient have an inclination with respect to the horizontal obtained by lifting one of the transverse edges of each of the aforementioned cushions, while the cushion adapted to the head, the one adapted to the calves and the one adapted to the ankles and the feet of the patient, subdivided into two juxtaposed portions, are raised relative to the table top of said massage table;

FIG. 5 schematically shows a perspective view of an embodiment of a massage table according to the invention, the table top being subdivided into two frames articulated to each other at the level of a joint, one of the frames, intended to accommodate the lower limbs of a patient, being lowered with respect to the second frame kept substantially horizontal, the configuration of the table permitting the patient to be positioned on his stomach;

FIGS. 6*a*, 6*b*, 6*c* and 6*d* show several schematic views of a particular embodiment of a detail of the vibrating massage table according to the invention, in this case one of the cushions, which said table includes, for example the cushion adapted to receive the head of the patient or the cushion adapted to receive the lumbar region or the cushion adapted to the pelvis and the thighs or the cushion adapted to the calves of a patient, in different positions; views 6*a* and 6*b* show said cushion inclined and raised with respect to its basic position at the level of the table top of said table, while views 6*c* and 6*d* illustrate said cushion in the basic position at the level of the table top and horizontally, without elevation or inclination;

FIGS. 7*a*, 7*b*, 7*c* and 7*d* show several schematic views of a particular embodiment of a detail of the vibrating massage table, in this case the cushion adapted to the ankles and the feet of the patient, subdivided into two juxtaposed portions, in different positions; views 7*a* and 7*b* show this cushion raised with respect to its basic position at the level of the table top of said table, while view 7*c* shows said cushion in the basic position at the level of the table top, horizontal, and view 7*d* illustrates a perspective view of the structure on which the two juxtaposed portions of the cushion adapted to the ankles and the feet of the patient rest;

FIG. 8 schematically shows a perspective view of a particular embodiment of the leg on which the table top of the vibrating massage table rests;

FIG. 9 illustrates a perspective view of an exemplary embodiment of the first frame the table top of the vibrating massage table is comprised of, intended to receive the lumbar region, the thorax and the head;

FIG. 10 shows a perspective view of an exemplary embodiment of the second frame the table top of the vibrating massage table is comprised of, intended to receive the pelvis, the thighs, the calves and the feet;

FIG. 11 is a diagram of the control system;

FIG. 12 illustrates an example of a user interface of the vibrating massage table of the invention.

DETAILED DESCRIPTION OF THE PREFERRED EMBODIMENTS

As shown in FIGS. 1 to 10 of the attached drawings, the present invention relates to a vibrating massage table 1, which can be used both for the well-being of the patient, who lies on said table 1, and for treating this patient when the latter suffers from musculoskeletal disorders.

The table 1 according to the invention namely includes a table top 2 resting on at least one leg 3, said table top 2 being advantageously comprised of a first frame 21 and a second frame 22.

The table top 2 of the vibrating table, comprised of the two frames 21, 22, is capable of tilting through a joint 4 with an axis 40, which is preferably a central axis 40, and hence of being inclined, thus permitting a progressive inclination of the body of the patient, who is lying on said table 1.

The mechanism permitting the tilting of the table top 2 of the table 1 can consist of any means known to those skilled in the art and suitable for this purpose.

More preferably, these tilting means consist of two electric jacks 270, one of which can be seen in the figures, permitting the rotation of the table top 2 about the joint 4 with a central axis 40, said jacks advantageously permitting to control the inclination of said table top 2.

Preferably, the body of the patient is so inclined that his feet are directed upwards, while the head is directed downwards from the table top 2, relative to the horizontal. This advantageously permits a natural extension of the body of the patient.

In particular, with reference to FIG. 3, the means for tilting the table top 2 about the central axis 4 can permit the table top 2 to be tilted by an angle α2 smaller than or equal to 18°, preferably smaller than or equal to 15°, with respect to the horizontal, always taking into consideration that the feet of a patient taking place on said table top 2 must be placed at a level higher than that of his head.

The patient thus extended on the inclined table top 2 is preferably retained on said table top 2, so as not to slip out of the latter. To this end, the present table 1 includes at least one retaining means, not shown in the figures.

Preferably, this retaining means permits to keep the patient on the table 1 through his lower limbs, for example the feet or the ankles, and is for example in the form of straps, not shown on the figures.

This retaining means can also consist of a pelvic belt system, for example in the hypothesis of the absence of the lower limbs.

The table 1 according to the invention also includes at least one motor means 13, namely shown in FIGS. 7*b* and 7*d*, permitting to propagate vibrations, so that at least a part of the body of the patient is subjected to vibrations, which can have a relaxing effect and/or a therapeutic effect.

Reference will be made in more detail to this motor means 13, which said table 1 includes, in the following description.

In a particularly advantageous way, the table top 2 of the vibrating massage table 1 according to the invention is subdivided into a plurality of transverse cushions 5, 6, 7, 8, 9, 10, each of these cushions 5, 6, 7, 8, 9, 10 being adapted to receive a specific part of the body of the patient lying on said table 1.

According to a peculiarity of the invention, one of the cushions, the cushion 10, is more particularly adapted to the ankles and the feet of the patient.

The cushion 10 is advantageously activated to vibrate by at least one motor means 13, shown in FIGS. 7*b* and 7*d*, and which can be located under said cushion 10, so that the vibrations are propagated to the entire body of the patient by causing a preliminary vibration of the ankles and the feet of the patient.

More particularly, still with reference to these FIGS. 7*b* and 7*d*, this motor means 13 transmits, through a transmission belt 14, vibrations to a shaft 15 that is, in turn, in connection with said cushion 10, so as to propagate these vibrations to the feet and the ankles of the patient resting at the level of the cushion 10, then to the entire body of the patient lying on said massage table 1.

According to a particular embodiment of the present massage table 1, said cushion 10 adapted to the ankles and to the feet of the patient is subdivided into two juxtaposed portions 11, 12, as shown in particular in FIGS. 4 and 5.

In a particularly advantageous way, at least one, and preferably each, of these two portions 11, 12 of the cushion 10 includes a means for retaining the body of the patient, for example in the form of straps intended to hold the ankles of the patient.

Holding by a lower area of the body is much more preferable than holding by the head, since the latter possibility can provide the patient with an unpleasant sensation, such as for example a feeling of strangulation.

In addition, when the patient is held by straps at the level of his ankles, he can attach himself to the table top 2. In addition, the patient preferably has at his disposal a means for immediately stopping the vibrations, as well as a means for controlling the inclination of the table top 2 so that, if he wishes so, he can stop the propagation of vibrations at any time and cause the table top 2 of the massage table 1 to return to a horizontal position. This advantageously permits to open the use of the table 1 according to the invention to self-medication, namely in gyms.

Preferably, the two portions 11, 12 of the cushion 10 will propagate the vibrations first to the lower area of the body of the patient, the feet and the ankles, then to his entire body.

To this end, the two portions 11, 12 of the cushion 10 are activated to vibrate by the presence of at least one motor means 13, as already mentioned above.

More particularly and preferably, each of said portions 11, 12 of the cushion 10, adapted to the feet and the ankles of the patient, can be activated alternately, first one, then the other one, by a motor means 13. Such activation of the portions 11, 12 of the cushion 10 permits to generate vibrations on each of the two portions 11, 12. The latter therefore vibrate alternately one after another.

Preferably, and as shown in FIG. 7*b*, the two portions 11, 12 of the cushion 10 are activated and put to vibrate by means of a single motor means 13, through a transmission belt 14 and a shaft 15 in contact, through its two ends, with each of said two portions 11, 12.

In other words, said portions 11, 12 vibrate alternately, for example under the action of transition means, namely through a system using an eccentric.

Preferably, the motor means 13 permit to propagate vibrations, both short vibrations and at a high frequency, to the entire body of the patient, starting from the feet and the ankles of the latter. This advantageously provides the patient, who is lying on the table 1 according to the invention, with a feeling of relaxation and softness.

According to a particularly advantageous embodiment of the invention, the vibrating massage table 1 also includes, in addition to the cushion 10 adapting to the feet and the ankles of the patient, and considering the average size of a person in his/her adult years (about 1.65 m for women and 1.80 m for men):

a first cushion 5, at one of the ends of the table top 2, adapted to receive the head of the patient and advantageously including a cervical support, not shown in the figures;

a second cushion 6, which adapts to the thorax of the patient;

a third cushion 7 adapted to the lumbar region of the patient;

a fourth cushion 8 adapted to both the pelvis and the thighs of the patient;

a fifth cushion 9 adapted to the calves of the patient.

Thus, the cushion 10 adapted to the ankles and the feet of the patient, and activated to vibrate, is considered to be the sixth cushion, and is positioned at the other end of the table top 2, in comparison with the positioning of the first cushion 5 adapted to the head.

Said cushions 5, 6, 7, 8, 9, 10 are butt-joined in the direction of the length of the table 1 by their respective transverse edges 203.

In a way particular to the invention, the present vibrating massage table 1 includes means for modifying the height of at least one of said cushions 5, 6, 7, 8, 9, 10 and/or means for modifying the inclination of at least one of the cushions 5, 6, 7, 8, 9, 10 by lifting one or the other of the transverse edges 203 of said cushion 5, 6, 7, 8, 9, 10.

Thus, in FIG. 1 of the attached drawings is shown an embodiment in which the cushions 6 and 8 adapted, respectively, to the thorax and the pelvis of the patient are raised and inclined by lifting one of their transverse edges 203, located on the side of the cushion 7, while the other cushions 5, 7, 9 and 10 are maintained in a horizontal position, the cushion 7 adapted to the lumbar region having an elevation.

In FIG. 4 is shown an embodiment in which the cushions 6, 7, 8 have an inclination by lifting only one of their transverse edges 203, while the cushions 5, 9, as well as the two juxtaposed portions 11, 12 of the cushion 10 adapted to the ankles and the feet of the patient have been submitted to an elevation from their basic position in contact with the table top 2 of the table 1.

It should be noted that, within the meaning of the invention, it is considered that the height of a cushion has been modified when the two transverse edges have been raised with respect to their basic position in contact with the table top 2 of the table 1, while, when only one of the two transverse edges has been lifted with respect to its basic position, and the second one has not been moved, it is considered that there has only been a modification of the inclination of the cushion in question.

It should also be noted that, when the two transverse edges of a cushion are raised while one of them is raised higher than the other one, there is both a modification of the height and of the inclination of the cushion being involved with respect to its basic position in contact with the table top 2 of the table 1.

Thus, through the massage table 1 of the invention, it is possible to position some parts of the body of the patient, namely the head of the latter, his thorax, or also his legs, at an angle, which is adapted to the treatment, and determined by a professional, regardless of whether the patient is positioned on his stomach or on his back. It is thus possible to create an undulation by means of the cushions, this undulation being adapted to the anatomy and to the treatment of the patient.

In an exemplary embodiment of the invention, all the cushions 5, 6, 7, 8, 9, 10 of the table top 2 of said table 1 are provided with such means for modifying the height and with such means for modifying the inclination by lifting one or the other of the transverse edges of said cushions.

In a different exemplary embodiment, said first cushion 5 adapted to receive the head of the patient and including a cervical support, said second cushion 6 adapted to the thorax of the patient, said third cushion 7 adapted to the lumbar region of the patient, said fourth cushion 8 adapted to the pelvis and the thighs of the patient and said fifth cushion 9 adapted to the calves of the patient are provided with such means for modifying the height and with such means for modifying the inclination by lifting one or the other of the transverse edges of said cushions 5, 6, 7, 8, 9, while said at least one sixth cushion 10 is provided only with means for modifying the height of the cushion, the latter remaining horizontal.

In this example, and with reference to FIGS. 6*a* to 6*d*, said first cushion 5, just like said second, third, fourth and fifth cushions 6, 7, 8, 9 include two transverse edges, the first one being lifted by means of a first jack 51, while the second transverse edge, opposite the first one, is lifted by means of the action of a second jack 52, and of the two columns 252, 253 stabilized by a spacer 254 under said first cushion 5, the columns being mounted through a pivot joint 250 at the level of their respective transverse edges.

Thus, the columns 252, 253 are raised through motor means such as a jack 52.

In the hypothesis shown in FIGS. 6*a* and 6*b*, where the jack 51 rises by a height smaller than the height of rising of the columns 252, 253, this results in a modification of the height and a modification of the inclination of the cushion 5, with respect to its basic position shown in FIGS. 6*c* and 6*d*.

As mentioned above, when only the jack 51 is caused to rise, while the columns 252, 253 do not move, there is only a modification of the inclination of the cushion 5. The same applies when only the columns 252, 253 and the cylinder 52 are caused to rise.

Obviously, all the cushions 5, 6, 7, 8, 9 can be provided with similar means, in order to be able to act on their position in height and inclination.

Thus, it is conceivable that the inclination of the cushions 5, 6, 7, 8, 9 varies by an angle $\alpha 3$ between +45 and −45° with respect to the horizontal. This is shown more particularly in FIG. 6*a*.

The possibility of an inclination by +45 to −45° of one of the cushions is obtained in cooperation or not with the lifting of said cushion on one side, in cooperation or not with the lifting of the neighboring cushions.

It is also conceivable that the cushion 10 adapted to the ankles and the feet of the patient is provided with similar means. However, such an embodiment is not shown.

Even more preferably, with reference to FIGS. 7*a* to 7*d*, said sixth cushion 10, advantageously comprising two juxtaposed portions 11, 12, is provided only with means for modifying the height of said cushion 10, which are in the form of a plurality of columns slidably mounted through the structure of the table top 2.

Thus, the portion 11 of the sixth cushion 10 is mounted on four columns, two columns 111 and 112 of which can be seen in FIGS. 7*b* and 7*d*, while the portion 12 of the same cushion 10 is also mounted on four columns, two columns 121 and 122 of which can be seen in these FIGS. 7*b* and 7*d*. The columns are mounted on a table top 16 and the assembly is capable of sliding through the structure of the table top 2 of the table 1, in order to pass from a first lower position, shown in FIG. 7*c*, to a higher position, which can be seen in the FIGS. 7*a* and 7*b*.

The maximum elevation of the cushions 5, 6, 7, 8, 9, 10, which the table top of the table 2 includes, is equal to 150 mm, with respect to the lowest basic position of each of said cushions 5, 6, 7, 8, 9, 10.

It should also be noted that, most preferably, the table top 2 of the massage table 1 of the invention is subdivided into two frames, a first frame 21, and a second frame 22, articulated to each other at the level of the joint 41 of the table top, with an axis 42, so as to permit a variation of the articulating angle $\alpha 1$, which the first frame 21 or the second frame 22 of the table top 2 forms with the other frame 22, 21.

Preferably, the articulating angle $\alpha 1$ between the two frames 21, 22, more particularly between the plane of the first frame 21 and the plane of the second frame 22, can be between 0 and +15°, when the patient is lying on the table 1 on his back, as shown in FIG. 2, and between 0 and −8°, the patient being, in this case, lying on his stomach, this possibility being shown in FIG. 5.

Thus, in other words, the massage table of the invention can adopt both a V-shaped configuration (FIG. 2), through the two frames 21, 22 articulated to each other at the level of the joint 41 with an axis 42 of the table top 2, permitting a positioning of the patient on his back and an inverted V configuration (FIG. 5) advantageously permitting the positioning of the patient lying on his stomach on the table 1 of the invention.

Preferably, a mechanism consisting of two electric jacks 271, one of which can be seen in the figures, permits the hinging of the two frames 21, 22 of the table top 2 about the joint axis 41, said jacks 271 more particularly permitting, advantageously, to control the inclination of the second frame 22.

Obviously, in addition to the hinging between the first frame 21 and the second frame 22 it is comprised of, at the level of the joint 41 with an axis 42, the table top 2 of the vibrating massage table 1 can also tilt about its joint 4 with a central axis 40 according to the angle $\alpha 2$, as shown in FIG. 3, which provides said table 1 with a particularly high modularity. Thus, it is conceivable that the entire table top 2 tilts about the central axis 4 (or not) for an inclination of the table top 2 at an angle $\alpha 2$ smaller than or equal to 18° with respect to the horizontal, then that the frame 22 of the table top 2 is still inclined through the joint 41 of the table top 2 at an angle $\alpha 1$, which can range from −8° up to 15°.

The joint 41 with an axis 42 of the table top 2, the first frame 21 and the second frame 22 forming the table top 2, and the central axis 40 for the tilting of the entire table top 2 are thus preferably juxtaposed and parallel, at different heights, and offset in the longitudinal direction.

As shown namely in FIGS. 2 and 3, the first frame 21 of table top 2 includes said first cushion 5, said second cushion 6 and said third cushion 7, while the second frame 22 of table top 2 includes said fourth cushion 8, said fifth cushion 9 and said at least one sixth cushion 10.

The first frame 21 and the second frame 22 of the table top 2 can be of the same or substantially the same length, however, it is also conceivable, still with reference to FIGS. 2 and 3, that the length of the first frame 21 of the table top 2 is larger, even slightly larger, than the length of the second frame 22 of the table top 2.

Preferably, at least one of these cushions 5, 6, 7, 8 and 9 is movable by sliding relative to the others, for example along a longitudinal axis of the table top 2 of the table 1.

However and even more preferably, at least one of the transverse cushions 5, 6, 7, 8 and 9 is movable relative to the other cushions 5, 6, 7, 8, 9 and 10 by sliding, over a limited stroke, on two parallel rails 260 located on each side of the table top 2 and visible in FIGS. 9 and 10, thanks to the linear bearing 261 shown in FIG. 6*d*.

Thus, the first five cushions 5, 6, 7, 8 and 9, respectively, adapted to the head, the thorax, the lumbar region, the pelvis and the thighs of the patient, as well as the cushion adapted to the calves are movable with respect to each other by sliding, over a limited stroke, on two parallel rails 260 located on each side of the table top 2 of the massage table 1 according to the invention, while the sixth cushion 10 remains stationary.

This last feature advantageously permits, during the inclination of the table top 2 of the table 1 and under the pressure of the body of the patient lying on said table top 2, that the cushions 5, 6, 7, 8 and 9 accompany the extension of the body by sliding namely along the rail, the density of the cushions absorbing part of the weight of the body, which generates an adhesion. The body nevertheless exhibits innate capacities to moderate the extension within physiological limits.

According to a particular embodiment, the massage table 1 according to the invention also comprises means for managing the sliding, not shown in the attached figures. Said means for managing the sliding are preferably associated with each of the longitudinally movable cushions, for example the five cushions 5, 6, 7, 8 and 9, so as to permit to limit the sliding of these cushions.

The presence of these integrated means thus permits to manage the sliding of cushions that can be movable, namely the cushions 5, 6, 7, 8 and 9, so that the latter follow the natural movement of the body of the patient at the time of its extension during of the inclination of the table top 2 of the table 1. The means for managing the sliding are also useful when the table 1 returns to a horizontal position, at the end of the treatment session, when the body of the patient is subjected to compression. Thanks to the action of these means, the body regains its normal compression under gravity.

In a particularly advantageous way, said means for managing the sliding capable of limiting the sliding of the mobile cushions, namely the cushions 5, 6, 7, 8, and 9, consist of jacks each of said cushions is provided with.

Through these means, it is conceivable to combine at least two, even more than two, cushions 5, 6, 7, 8, 9, 10 to each other, in order to thus form one or more cushion segments.

Only the cushion 10 is vibrating and generates a vibratory frequency, which will travel along the body of the patient. The other cushions 5, 6, 7, 8, 9 mounted on the parallel rails 260 accompany the natural extension of the body associated with the slope of the table top 2. However, these cushions 5, 6, 7, 8, 9 can be fastened to each other, so as to limit the extension and to segment the vibratory frequency.

It should be noted that the massage table 1 according to the invention may also include at least one anti jamming system equipping each of the cushions, in order to prevent the patient from trapping his fingers during the movement of said cushions by sliding or raising relative to each other.

Advantageously, the table 1 of the invention is furthermore equipped with a management module 100, shown in FIG. 11, at least for the height and/or the angle of inclination $\alpha 3$ of the cushions and, where appropriate, for the articulating angle $\alpha 1$ between the first frame 21 and the second frame 22 of the table top 2 as well as for the management of the tilting angle $\alpha 2$.

This management module 100 is also capable of controlling the vibration parameters of the sixth cushion 10, namely the frequency and intensity, by controlling the motor means activating the vibration of said sixth cushion 10, more particularly one and/or the others of the juxtaposed portions 11, 12 of this sixth cushion.

The management module 100 can be controlled, for example by a healthcare professional, by means of a user interface as shown in FIG. 12, which can be displayed on a touchscreen display 101 of the massage table 1, or else on a remote touchscreen tablet 105.

Said interface permits to act on all the parameters of the vibrating massage table 1, which can be modified and part of which has been listed above.

Thus, the information is sent from the touchscreen display 101 or the touchscreen tablet 105 to a processor card 102 of the module 100 directly as regards the touchscreen display 101 or indirectly via a local network 104 in the case of the touchscreen tablet 105 (Wifi and/or Ethernet). An electronic card 103 including the power components forms the interface between the control of the processor 102 and the various actuators, in this case the jacks 51, 52 equipping each of the cushions 5 to 10 for their lifting and/or their inclination, the cylinders 270, 271 for inclining the table top 2 and the frames 21, 22, respectively, and the motor 13.

This management module 100 is associated with software that can be set up and/or updated for example by means of a computer 106, permitting to adapt, preferably automatically, the positioning of the table 1 and its cushions 5, 6, 7, 8, 9, 10 to the morphology of the patient, in particular his size and weight, this information being manually input into the software. A scale can, for example, be connected in connection with the management module 100, or an automatic weight sensor can be incorporated into the table 1.

The different information can also be shared via the local network 104 and/or the Internet network 107.

It should also be noted that predefined programs may advantageously be available regarding the user interface, these programs being developed from a large collection of data obtained through fundamental and clinical research, and may be adjusted automatically according to the size and the weight of the patient.

In addition and advantageously, once a program will be determined for a patient, namely as regards the vibratory frequency, the slope, the orientation, in particular of the cushions 5 to 9, and the duration of the session, the patient can implement this program by connecting to the management module 100, at a health practitioner, in a gym, at an airport, or in any other place and irrespective of the country, equipped with the vibrating massage table 1 according to the invention, in order to recover more quickly after a long-haul flight, for example.

Thus, the vibrating massage table 1 according to the invention advantageously permits to combine a treatment of the human body by the vibrations propagated through the cushion 10 with a more or less significant inclination of the body, made possible by tilting the table top 2, and permitting a passive stretching of the body by gravity. In addition, the mobility through longitudinal sliding, namely of the first five cushions 5, 6, 7, 8 and 9, permits gentle support for the extension of the body by gravity.

Such an association between the vibrations, propagated from the feet and the ankles, and a varying inclination of the table top 2 of the table 1 can, in a particularly interesting way, open the way to neuro-vertebral decompression, namely of the intervertebral discs. Such a decompression permits to promote micro-oxygenation of the intervertebral joints, which is generally accompanied by a decompression of the spinal nerves, which are namely responsible for the sensitivity and motricity of the limbs as well as for the regulation of hyperarousal.

Different dynamic processes, namely the circulation of the blood, lymphatic and cerebrospinal flows are occurring at all times, at the level of the pelvis, the spine and the skull in the form of a wave.

The inclination and vibration will adjust and harmonize this primary wave motion, which, in turn, will restore the inherent mobility of the spinal and pelvic joints. Therefore, this form of passive elongation, without forced traction, and of oscillation will permit neuro-vertebral decompression, whether it is of traumatic and/or inflammatory origin.

In addition, the propagation of vibratory waves from one of the extremities of the human body, in this case a propagation from the feet and ankles, permits to avoid to create a defensive physiological state in the patient, which can occur for example when several parts of the body vibrate simultaneously or when the vibrations are transmitted through the head of the patient.

The vibrating massage table 1 according to the invention can advantageously be used for therapeutic purposes; indeed, the association between vibrations and the stretching of the body by gravity accompanied by a displacement of the cushions, for example the cushions 5 to 8, namely permits to treat problems of protrusion of the intervertebral discs, ranging from simple disc protrusion up to the herniated disc.

According to another advantageous application, the present vibrating massage table 1 can be used before and/or after a more or less intense physical effort. The features of said table 1 will permit a particularly interesting relaxing effect for the body of the patient being treated, and namely at the level of the musculoskeletal complex.

Thus, the vibrating massage table 1 according to the invention has both a preventive application and a curative application for a patient. Many physiological parameters can be improved thanks to the features of table 1, either by changing the position with regard to the gravity vector, including the different possibilities of inclination, or by the vibrations, or by a specific combination of the two systems adapted to each case.

Thus, for example, the inclination of a patient on the massage table of the invention could be at the initiative of the osteotendinous reflex and, in combination with the vibratory activity, will without risk promote the release of the tendons, the ligaments, the discs, their physiological wastes, and will also have the effect of improving blood circulation and that of the cerebrospinal fluid for repairing the damaged tissues.

It should also be noted that the present vibrating massage table 1 is not limited to the spinal treatments and to the treatments for musculoskeletal disorders, but can also be implemented in the treatment of other pathologies, namely in the pulmonary, circulatory, lymphatic pathologies, and those involving a weak immune system. It has been found that the vibrations or the modulation of the position with respect to the gravity vector permit an increase of the lymphocytes, a decrease of the inflammatory markers and simultaneously an increase of the anti-inflammatory markers.

Indeed, unlike basic inversion tables, raising at least one of the cushions 5, 6, 7, 8, 9, 10 as well as the inclination of preferably at least one of the cushions 5, 6, 7, 8, 9, by supporting the lumbar curvature will permit to reduce orthostatic stress and to reduce the risk of increased blood pressure and intraocular pressures.

In addition, the Trendelenburg position with the body of the patient lying flat on his back, the latter being inclined with the feet at a level higher than that of the head, associated with raising at least one of the cushions 5, 6, 7, 8, 9, 10, improves splanchnic vasoconstriction and venoconstriction, as well as venous return, through the double action of increasing the muscle tone of the walls of the blood vessels, and the activation of the abdominal pump.

As regards the interest of the vibrating massage table 1 in respiratory pathologies, through the combination of gravity and vibrations, by contributing to strengthen the contractility of the muscles, said table 1 namely contributes to the drainage of the sinuses, the bronchi and the respiratory system in general. Therefore, the table 1 will be particularly useful in the case of treating patients suffering from pathologies such as sinusitis, chronic obstructive pulmonary disease, cystic fibrosis, etc.

In addition, the vibrating massage table 1 can be used as a medical bed, namely to prevent thrombosis in the patient in a situation of prolonged bed rest. Here should be noted the specificity of the joint 41, which, by providing a new angulation, permits the lower limbs to be raised without excessive inclination of the rest of the body and namely of the neck and the head.

On the other hand, the inclination and/or the vibrations will permit to stimulate the proprioceptive receptors by initiating the muscular adaptation, and to strengthen the structure of the muscle fibers by relaunching the muscular activity, without constraint.

The vibrating massage table according to the invention can have many other therapeutic applications, namely, for example, a usefulness in the treatment of neurological disorders such as those caused by the Parkinson's disease or those of multiple sclerosis, postural control, balance, coordination and walking, fibromyalgia, spasticity, etc.

What is claimed:

1. Vibrating massage table (1) comprising at least one support leg (3) on which rests a table top (2) capable of tilting about a joint (4) with a central axis (40) and permitting an inclination of a patient taking place on said table (1) so that the feet of the patient are placed at a level higher than that of his head, said table top (2) including several transverse cushions (5, 6, 7, 8, 9, 10) each adapted to a part of the body of the patient, a first cushion (5) at one end of the table top (2) adapted to receive the head of the patient, a second cushion (6) adapted to the thorax of the patient, a third cushion (7) adapted to the lumbar region of the patient, a fourth cushion (8) adapted to the pelvis and the thighs of a patient, a fifth cushion (9) adapted to the calves of the patient, at least one sixth cushion (10), at the other end of the table top (2), adapted to the ankles and the feet of the patient, said at least one sixth cushion (10) being activated to vibrate by at least one motor means (13), said vibrations being propagated from the ankles and the feet to the entire body of the patient, said cushions (5, 6, 7, 8, 9, 10) being butt-joined in the direction of the length of the table (1) by their respective transverse edges (203), said table (1) being characterized in that it includes means for modifying the height of at least one of the cushions (5, 6, 7, 8, 9, 10) and means for modifying the inclination of at least one of the cushions (5, 6, 7, 8, 9, 10), the modification of the inclination being effected by lifting one or the other of the transverse edges (203) of said cushion (5, 6, 7, 8, 9, 10) and in that the table top (2) of the table (1) is subdivided into two frames, a first frame (21) and a second frame (22) articulated to each other at a joint (41) so as to permit a variation of an articulating angle $\alpha 1$ that said first frame (21) of the table top (2) forms with said second frame (22) wherein the articulating angle $\alpha 1$ between the first frame (21) and the second frame (22) of the table top (2) reaches +15° and −8°, wherein the joint (4) is connected to the first frame (21) wherein the sixth cushion (10), adapted to the ankles and the feet of the patient, includes a means for retaining the ankles and/or the feet of the patient, wherein the vibrating table is equipped with a management module (100) at least for controlling the articulating angle $\alpha 1$ of first frame (21) and a second frame and the angle $\alpha 2$ of inclination of the table top (2) about joint (4).

2. Vibrating massage table (1) according to claim 1, wherein said first cushion (5) adapted to receive the head of the patient, said second cushion (6) adapted to the thorax of the patient, said third cushion (7) adapted to the lumbar region of the patient, said fourth cushion (8) adapted to the pelvis and the thighs of the patient and said fifth cushion (9) adapted to the calves of the patient are provided with such means for modifying the height and such means for modifying the inclination by lifting one or the other of the transverse edges (203) of said cushions (5, 6, 7, 8, 9), while said at least one sixth cushion (10) is provided only with such means for modifying the height.

3. Vibrating massage table (1) according to claim 1, wherein the sixth cushion (10), adapted to the ankles and to the feet of the patient, is subdivided into two juxtaposed portions (11, 12), said portions (11, 12) being activated, in an alternating manner, to vibrate by a driving means (13), through a transmission belt (14) and a shaft (15) in contact, by means of its two ends, with each of said two portions (11, 12).

4. Vibrating massage table (1) according to claim 1, wherein the first (5), second (6), third (7), fourth (8) and fifth (9) cushions are each provided with a linear bearing (261) and are movable with respect to each other by sliding, over a limited stroke, on two parallel rails (260) located on each side of the table top (2), said table top (2) also including means for managing the sliding and capable of limiting the sliding of the movable cushions (5, 6, 7, 8, 9), said means for managing the sliding consisting of jacks equipped with springs provided on each of said movable cushions (5, 6, 7, 8, 9).

5. Vibrating massage table (1) according to claim 1 wherein means for tilting about a joint (4) with a central axis (40) permit an inclination of the table top (2) by an angle $\alpha 2$ smaller than or equal to 18° relative to the horizontal, so that the feet of a patient taking place on said table top (2) are placed at a level higher than that of his head.

6. Vibrating massage table (1) according to claim 1, wherein the inclination of at least one of the cushions (5, 6, 7, 8, 9) by reaches an angle $\alpha 3$ between +45° and −45°, the modification of the inclination being effected by lifting one or the other of the transverse edges (203) of said cushion (5, 6, 7, 8, 9).

7. Vibrating massage table (1) according to claim 1 wherein said means for modifying the height of at least one of the cushions (5, 6, 7, 8, 9, 10) are capable of varying the height of at least one of the cushions (5, 6, 7, 8, 9, 10) up to a maximum elevation of 150 mm with respect to the basic position of said cushion (5, 6, 7, 8, 9, 10).

8. Vibrating massage table (1) according to claim 1 wherein it is equipped with a management module (100) at least for controlling the height of one or more of the cushions.

9. Vibrating massage table (1) according to claim 1 wherein it is equipped with a management module (100) at least for controlling the inclination of the cushions (5, 6, 7, 8, 9, 10).

* * * * *